US006904780B2

(12) United States Patent
Bullinger et al.

(10) Patent No.: US 6,904,780 B2
(45) Date of Patent: Jun. 14, 2005

(54) APPARATUS FOR MAKING SEAMLESS SIDING PANEL

(75) Inventors: Michael J. Bullinger, Fargo, ND (US); Russell L. Cooper, Crewell, OR (US)

(73) Assignee: United States Seamless, Fargo, ND (US)

( * ) Notice: Subject to any disclaimer, the term of this patent is extended or adjusted under 35 U.S.C. 154(b) by 57 days.

(21) Appl. No.: 10/431,673

(22) Filed: May 8, 2003

(65) Prior Publication Data

US 2003/0192281 A1 Oct. 16, 2003

Related U.S. Application Data

(62) Division of application No. 09/747,367, filed on Dec. 21, 2000, now abandoned.

(51) Int. Cl.[7] ..... B21D 5/08; B21D 43/28
(52) U.S. Cl. ..... 72/130; 72/177; 72/181
(58) Field of Search ..... 72/177, 181, 179, 72/182, 129, 130

(56) References Cited

U.S. PATENT DOCUMENTS

| | | | | | |
|---|---|---|---|---|---|
| 1,905,398 | A | * | 4/1933 | Schnell | 72/177 |
| 2,250,764 | A | | 7/1941 | Hoess | |
| 3,059,685 | A | | 10/1962 | Behlen | |
| 3,150,707 | A | * | 9/1964 | Howell | 72/177 |
| 3,159,943 | A | | 12/1964 | Sugar et al. | |
| 3,214,876 | A | | 11/1965 | Mattes | |
| 3,520,099 | A | | 7/1970 | Mattes | |
| 3,710,607 | A | * | 1/1973 | Beymer | 72/178 |
| 3,791,185 | A | | 2/1974 | Knudson | |
| 3,918,283 | A | * | 11/1975 | Kosch et al. | 72/177 |
| 4,020,666 | A | * | 5/1977 | Beymer | 72/177 |
| 4,065,899 | A | | 1/1978 | Kirkhuff | |
| 4,130,974 | A | | 12/1978 | Chalmers et al. | |
| 4,343,171 | A | * | 8/1982 | Kagawa | 72/181 |
| 4,399,643 | A | | 8/1983 | Hafner | |
| 4,450,701 | A | * | 5/1984 | Treiber et al. | 72/181 |
| 4,506,486 | A | | 3/1985 | Culpepper, Jr. et al. | |
| D291,249 | S | | 8/1987 | Manning | |
| 4,787,233 | A | | 11/1988 | Beymer | |
| 4,864,788 | A | | 9/1989 | Tippmann | |
| 5,038,477 | A | | 8/1991 | Parrow | |
| 5,088,309 | A | * | 2/1992 | Knudson | 72/129 |
| 5,181,358 | A | | 1/1993 | Mead | |
| 5,271,878 | A | | 12/1993 | Mizia et al. | |
| 5,465,543 | A | | 11/1995 | Seifert | |
| 5,586,422 | A | | 12/1996 | Hoffner | |
| 5,694,728 | A | | 12/1997 | Heath, Jr. et al. | |
| 5,878,542 | A | | 3/1999 | Cornelius | |
| 6,263,574 | B1 | | 7/2001 | Lubker, II et al. | |
| 6,298,626 | B2 | | 10/2001 | Rudden | |
| 6,408,580 | B1 | | 6/2002 | Jurvis et al. | |
| 2001/0017020 | A1 | | 8/2001 | Kern | |

FOREIGN PATENT DOCUMENTS

| | | | | |
|---|---|---|---|---|
| JP | 46822 | * | 3/1985 | 72/177 |
| JP | 33124 | * | 2/1988 | 72/177 |

* cited by examiner

*Primary Examiner*—Daniel C. Crane
(74) *Attorney, Agent, or Firm*—Merchant & Gould P.C.

(57) ABSTRACT

A siding system includes panels having a facing element with a convex front face portion. A first connecting portion extending along an upper edge and a second connecting portion at a lower edge is adapted to engage the first connecting portion of an adjacent lower siding panel. Mounting holes at a top edge of the facing element provide for mounting the siding panel to a vertical surface. A support element, such as foam insulation attaches to a rear surface of the facing element. A machine for making the metal siding panels has a feeder and multiple roller sets. First ones of the rollers have a concave portion and complementary second ones of the rollers have a convex portion. The concave portion first roller set has a larger radius profile than the last roller set to roll form the siding from a coil of blank material. Bending rollers form the mounting structure of the panels. Embossing rollers forming an embossed pattern on the face of the panels.

19 Claims, 20 Drawing Sheets

APPARATUS FOR MAKING SEAMLESS SIDING PANEL

CROSS REFERENCE TO RELATED APPLICATIONS

This application is a divisional application of application Ser. No. 09/747,367 filed Dec. 21, 2000 ABN which application(s) are incorporated herein by reference.

BACKGROUND OF THE INVENTION

1. Field of the Invention

The present invention relates to a siding element having an appearance of log construction, and in particular to a metal seamless siding element, an apparatus for making the siding and a method of making the siding.

2. Description of the Prior Art

Various types of siding for houses and other structures have been developed. Vinyl siding, aluminum siding and steel siding have all been developed as low maintenance or maintenance free siding options that do not require painting and other normal maintenance tasks. Some types of siding provide the additional advantage of being seamless, wherein siding elements are cut to a desired length spanning the entire distance from a corner or interruption in the siding to the next such occurrence. Seamless siding provides the advantages of uninterrupted siding that is more aesthetically pleasing. In addition, the lack of seams also provides greater protection from the elements and improved insulating properties.

In order to accommodate seamless siding, it is generally necessary to cut the siding that typically comes off a spool in a continuous coil of material at the site where the siding is being hung. Cutting length at the job site therefore requires a specialized cutting machine that is portable and that is typically trailered to the job site. In addition to providing an arc on the siding simulating log siding, such a device must also form the flange or mounting structure onto the siding panels. It can be appreciated that metal siding, which affords greater protection and wears better than vinyl siding, has special requirements in forming the siding due to its stiffness as opposed to vinyl siding that may be easily extruded or formed.

Although textured sidings, such as vinyl siding are well known, it is more difficult to form a textured harder siding element, such as metal siding from a blank coil of material. However, such formation improves the overall quality of the siding on the house or other structure if it is seamless. Providing texture to the siding encounters special problems when the siding is a metal siding as the material is generally quite hard and more difficult to emboss or texture than other siding materials. The additional weight and special handling required for metal siding from a spool requires additional considerations for forming such panels from continuous metal material.

In order to create an appearance similar to log structures, it is necessary to provide a textured and arcing profile to siding elements. Providing an arc to the element for a seamless siding system is especially difficult as the material must be formed by a portable device at the job site. In addition, the material with its arcing profile must be cut to length at the job site. In addition to putting the arc in the siding elements, the flanges for attaching to the structure and to the aligning and engaging adjacent upper and lower edges of siding elements is also needed. Providing flanges and texture and an arc all with a portable device is a special challenge for seamless metal siding.

It can be seen that a new and improved metal siding system is needed that provides the aesthetically pleasing appearance of a log structure. In addition, such a system should provide a seamless siding system wherein the siding elements are cut to the required length needed for the structure at the job site. A feasible device and method for making such siding elements is needed. In addition to providing an arc and flange, such a device and system should impart texture for improved strength and aesthetics. The present invention addresses these as well as other problems associated with seamless metal siding having the appearance of logs.

SUMMARY OF THE INVENTION

The present invention is directed to a seamless metal siding panel, and in particular to a panel having the appearance of log siding, as well as to a method and apparatus for making such panels.

Each siding panel includes an arcing portion having an outer surface with a diameter substantially that corresponding to a log type home construction. In addition, the panel may be painted or otherwise have a color pattern to simulate wood grain and may be embossed with a wood grain texture. The panels preferably have a hook type portion on the lower edge of the panel and a flange for mounting and for engaging the hook type portion along an upper edge of the panel. The flange preferably includes mounting holes or other structure for mounting to the wall of a building. The panel preferably includes Styrofoam or other insulation beneath the arc portion, providing support to the arcing portion of the metal panels as well as improved durability and protection. The panels are seamless and cut to the desired length from a continuous coil of blank material at the job site.

The device for forming the panels includes a rigid frame with a series of roller sets receiving the blank material and bending the material into the desired final shape. In addition, the rollers are driven by a motor and connected by chain type drives on sprockets about the ends of the shafts of the rollers to ensure that the rollers are all driven at substantially the same speed and to ensure alignment and proper feeding of the material.

The blank material is first fed through a punch station wherein a roller includes a plurality of punches extending outward from the periphery of the roller at one end to form spaced apart holes along one edge of the blank material for mounting purposes. Following punching on the mounting holes, the material is fed through an embossing station wherein a pair of rollers engage the material and press a contoured surface onto the blank coil of metal. It has been found that embossing not only provides improved texture for hiding imperfections and for improved aesthetics resembling wood grain, but also provides unexpected improved support as compared to arced panels that are not embossed.

The embossed blank passes through a series of roller pairs having complementary arcing peripheries. The roller sets include arc forming rollers that generally include upper rollers with a concave periphery, or have portions that include a concave periphery, and complementary lower rollers that have a complementary convex periphery. In addition, one of the rollers may include a periphery having an edge for bending the edge of the material into the bottom hook portion. The opposite edge of the rollers may include a periphery for forming the bend and a complementary hook of the flange. The rollers have generally successively smaller radiused arcing surfaces and generally have their edges moving closer together from the initial roller to the later encountered rollers. In a preferred embodiment, the last three arcing roller sets have identical profiles to ensure that the panels have the same profile. The contours of the flange forming portion change from roller set to roller set. In addition, intermediate the arc forming roller pairs are sets of rollers that further aid in guiding and tensioning the continuous coil of material and in forming the structure at the edges of the siding panels. The edges of these alternating rollers on their edges and their orientations change from roller to roller due to the changes in shape of the material as it progresses along the roller sets while aiding in gradually achieving the final structure of the siding panels.

The panels are cut to length at a cutting station at the exit end of the rollers. The cutting station is preferably mounted on a sliding or other movable frame so that the desired length required for each siding panel can be easily achieved for optimum fit. The cutting station includes a die having an arcing upper edge generally conforming to the inner periphery of the arcing section of the siding panels. A pivoting blade includes a concave edge substantially complementary to the panels to provide a cleaner cut at the end of the panel sections.

These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWING

Referring now to the drawings, wherein like reference letters and numerals indicate corresponding structure throughout the several views.

DETAILED DESCRIPTION OF THE PREFERRED EMBODIMENT

Figure 1:
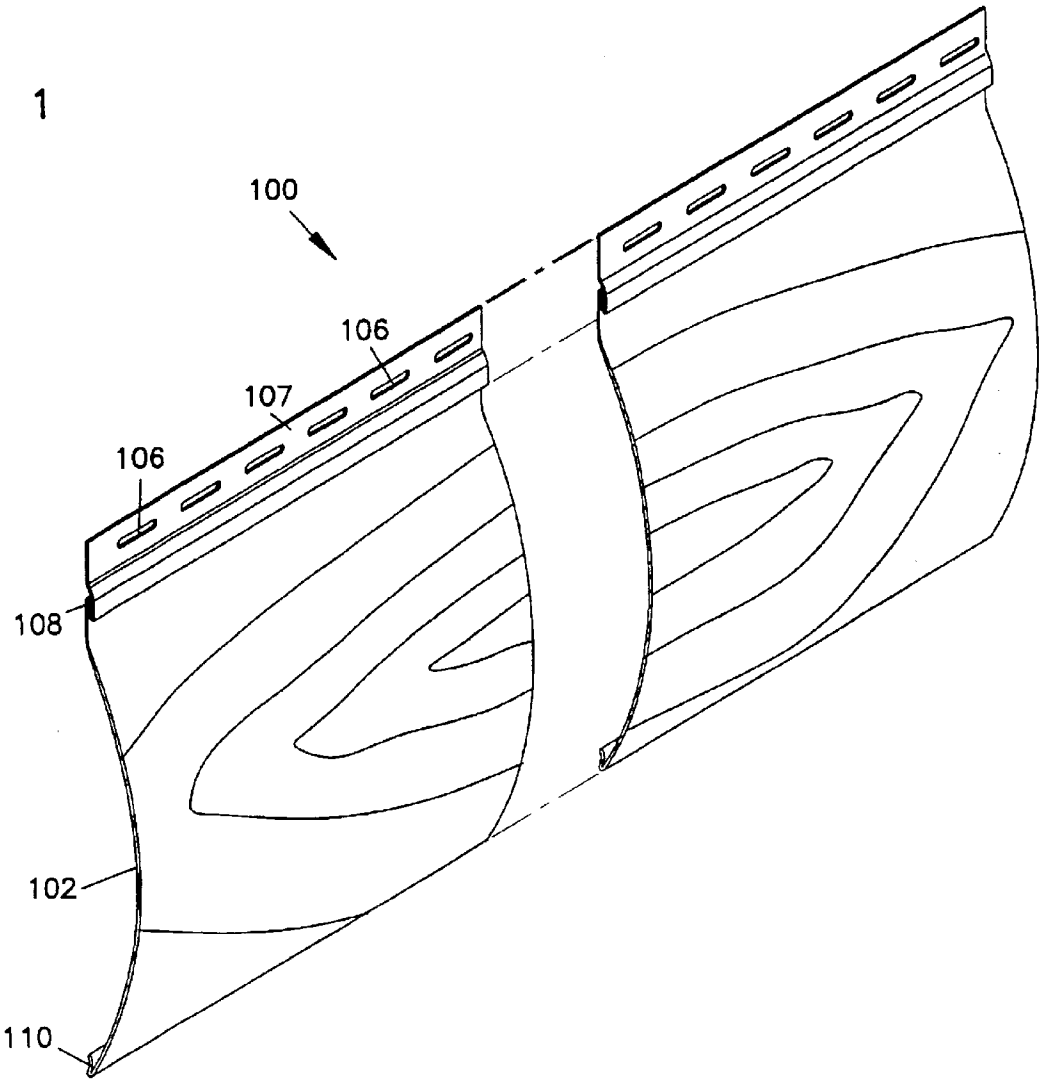
FIG. 1 shows a perspective view of a siding panel element according to the principles of the present invention.
Figure 2:
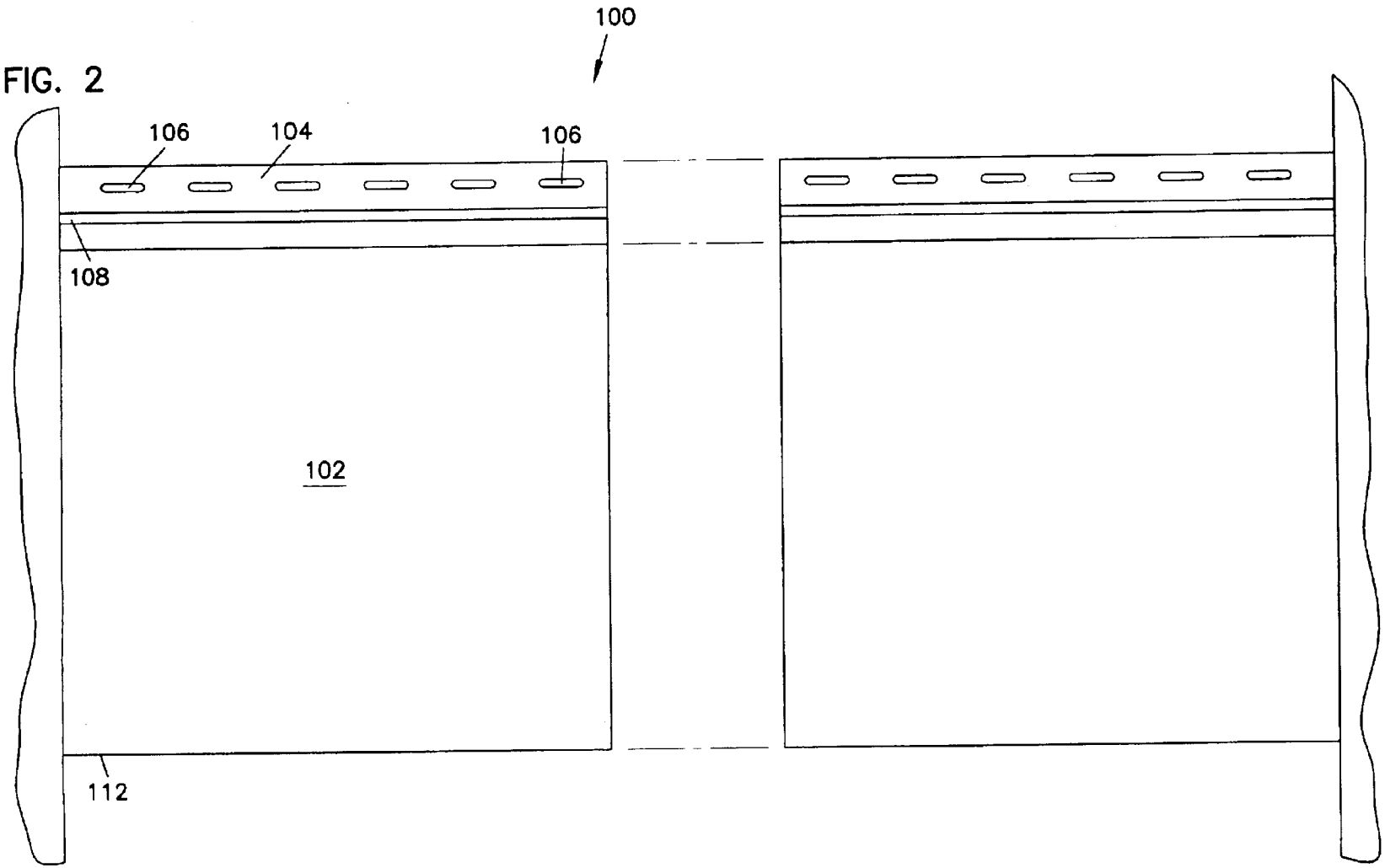
FIG. 2 shows a front elevational view of the siding panel shown in FIG. 1 cut to a predetermined length and abutting building structures at each end.
Figure 3:
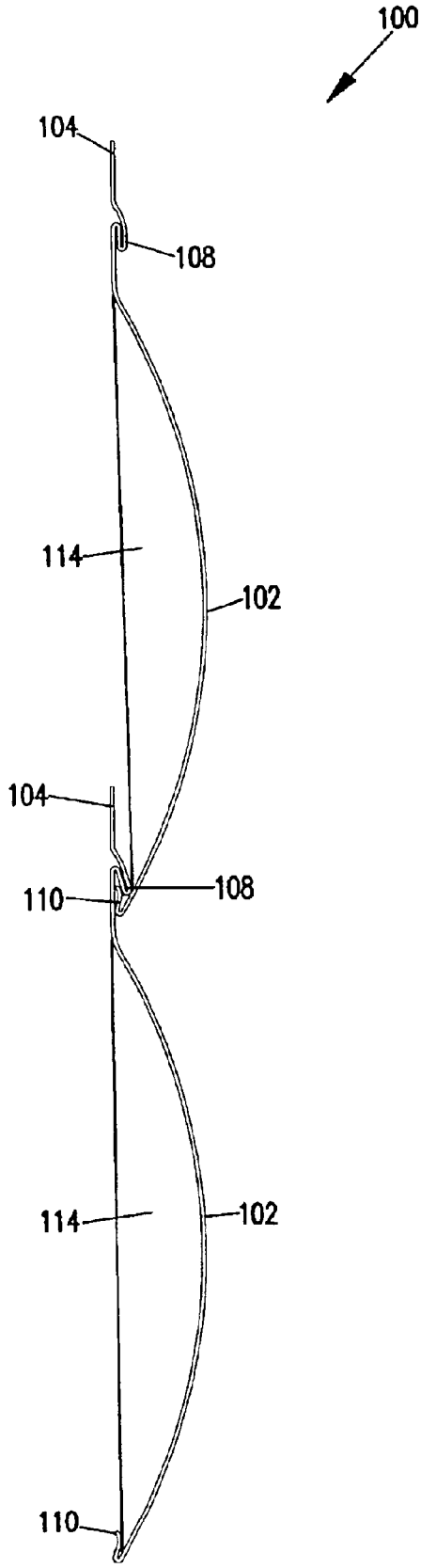
FIG. 3 shows an end elevational view of siding panels shown in FIG. 1 joined to form building siding.

Referring now to the drawings, wherein like reference numerals and letters indicate corresponding structure throughout the several views, in particular referring to FIG. 1, there is shown a seamless siding panel, generally designated 100. The panel 100 includes an arcing outer surface 102 and a flange 104 along a first edge, as also shown in FIGS. 2 and 3. The upper flange 104 has a hook portion 108 formed therein that engages a complementary bottom hook 110 to join the panels 100 together to form extended siding covering the side of the building, as shown in FIG. 3. The bottom hook portion 110 may also include spaced apart weep holes 112 to allow water to drain from the panel 100. The flange 104 includes spaced apart mounting holes 106 for attaching the panels 100 to the side of a building.

Figure 4:
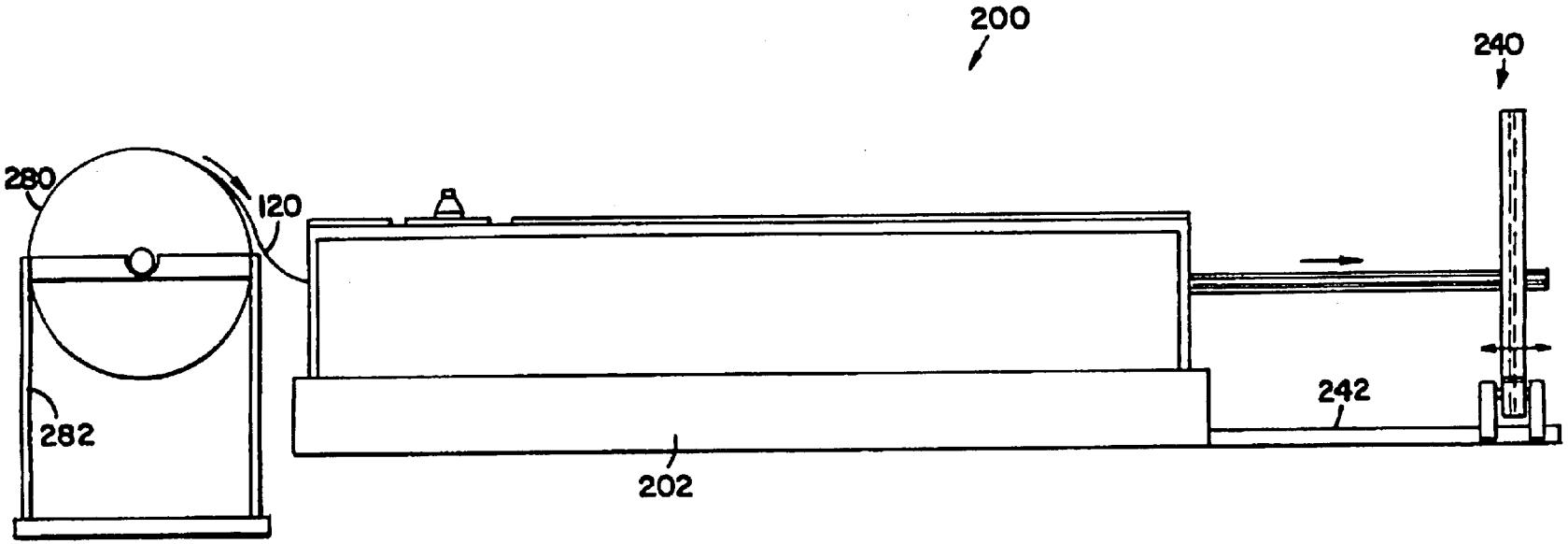
FIG. 4 shows a side elevational view of an apparatus for making the siding panels shown in FIG. 1 according to the principles of the present invention.

Foam insulation, molded polystyrene, or other support material 114 substantially follows the interior of the arcing portion 102. Referring again to FIGS. 1 and 2, the exterior of the arcing portion 102 preferably includes a wood grain type pattern and is embossed, as explained hereinafter, to give the arcing portion 102 the texture as well as the visual color pattern for log siding. It can be appreciated that the panels 100 may also be made without an embossed surface. In a preferred embodiment, the panels 100 are made from a continuous metal material 120, such as treated steel or aluminum, or alloys, wound on a spool 280, as shown in FIG. 4 and are cut to length to form a continuous, or seamless siding extending between building corners or other structure, as shown in FIG. 2 and as explained hereinafter. In this manner, seamless siding with surprising durability is obtained. Where it is impractical to cut the individual panels to required length, the panels 100 may be cut to a standard length, such as twelve feet and cut to the required length with shears at the job site. It has been found that an embossed siding panel 100 provides improved strength over panels just having an arc formed therein.

Figure 5:
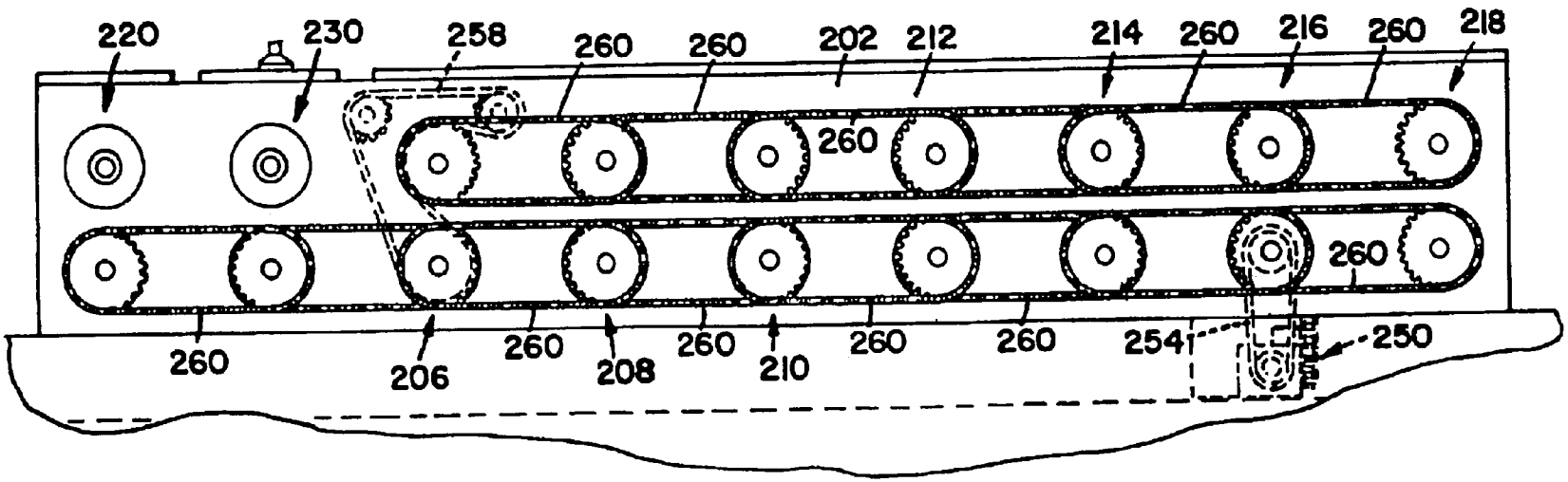
FIG. 5 shows a side elevational view of the frame portion of the apparatus shown in FIG. 4.
Figure 6:
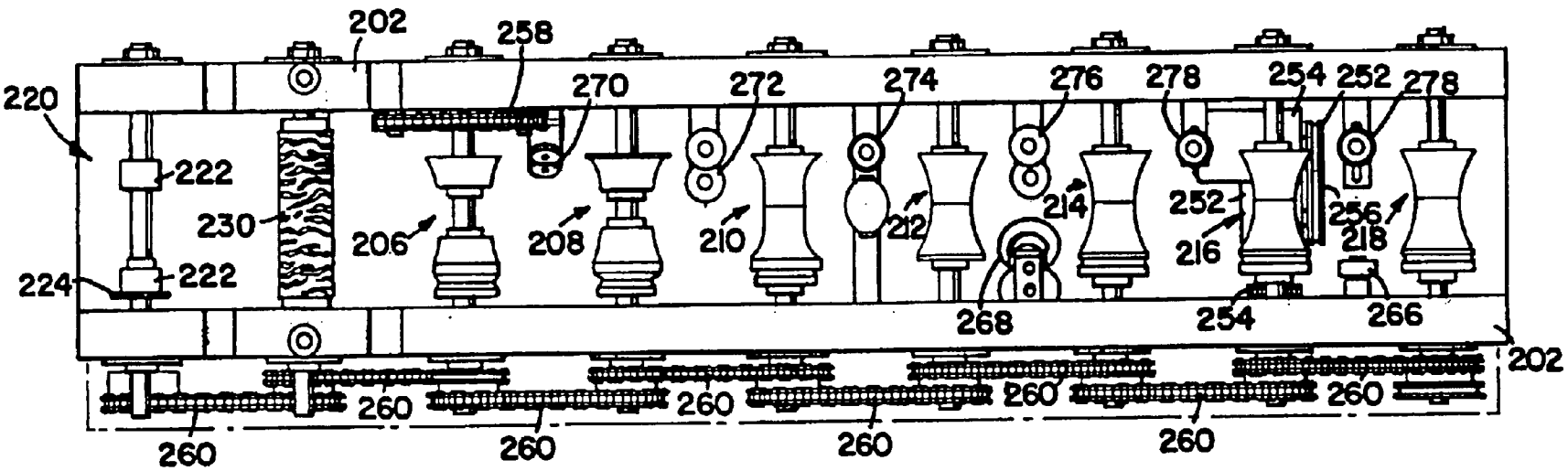
FIG. 6 shows a top plan view of the frame portion of the apparatus shown in FIG. 4.

Referring now to FIGS. 4–6, there is shown a panel forming apparatus, generally designated 200. The apparatus 200 supports a spool 280 of the blank siding material 120 and feeds it through a series of rollers to achieve the panel 100 shown in FIGS. 1–3 and is cut to length at an exit end at a cutting station 240. The siding forming apparatus 200 is preferably placed on a trailer or is otherwise portable to the job sites, so that the siding panels 100 may be cut to the length that is required for each panel to provide a seamless siding system. The continuous coil of blank material 120 is fed to the siding forming apparatus 200 and through a series of roll forming rollers, as explained hereinafter. The roller sets 206, 208, 210, 212, 214, 216 and 218 bend the blank material 120 gradually to the arced configuration shown in FIGS. 1–3. In addition, the flange 104 and other features of the panel 100, including the embossed surface, are accomplished as the blank 120 passes through the series of rollers. Upon exiting the series of rollers, the material is passed through a cutting station 240 shown in FIG. 8. The cutting station 240 includes a blade 244 and handle 246 with a die 248 having an upper surface substantially conforming to the profile of the panel 100 providing improved support along the entire arc. The cutting station 240 is slidably mounted relative to the apparatus 200 on a framework 242 that telescopes to move the cutting station 240 to a desired position so that the siding may be cut to the length needed for the specific placement of each particular siding panel 100. With this arrangement, there is no overlap or seams in the siding and a proper fit is obtained for each specific piece.

Figure 7:
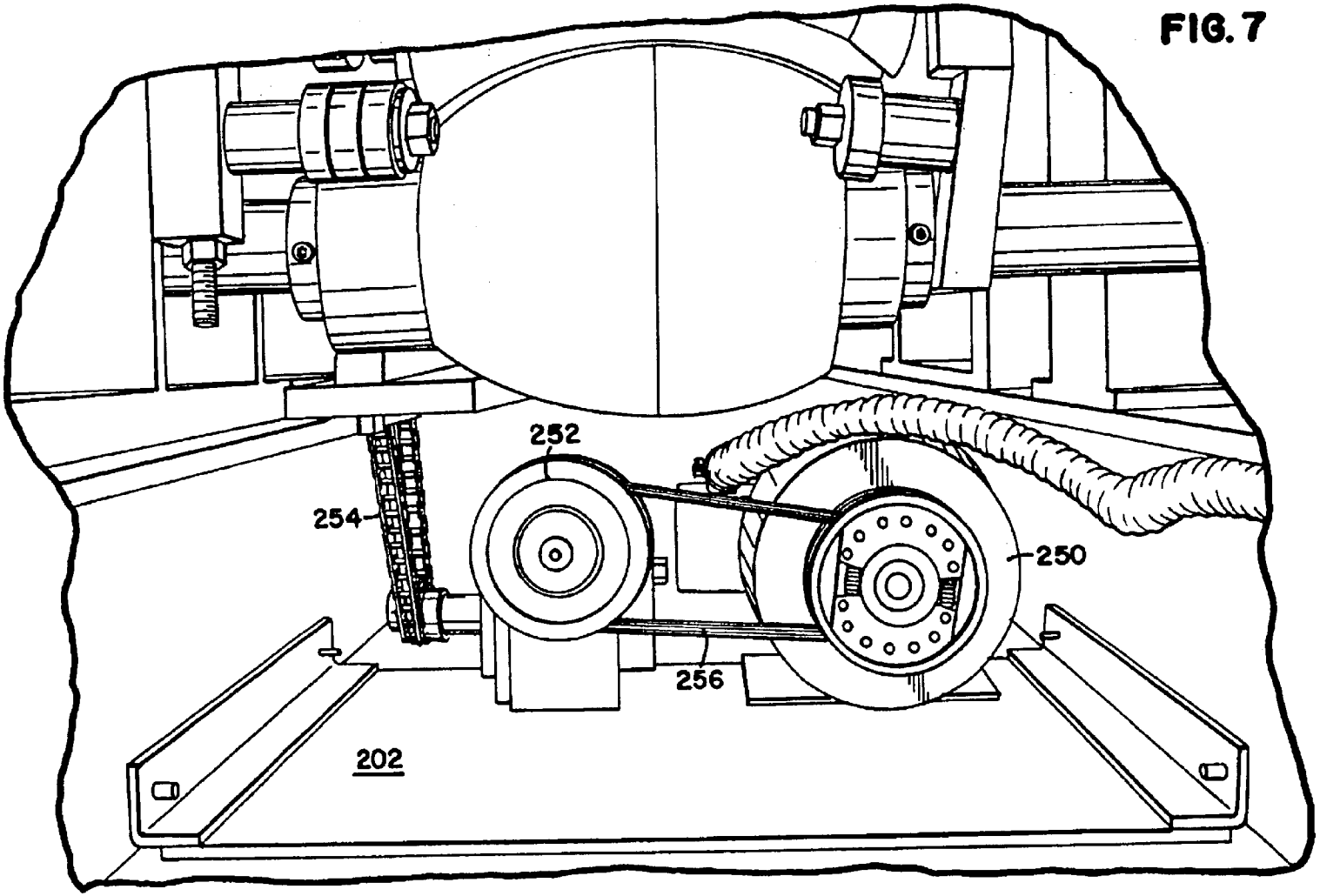
FIG. 7 shows a side elevational view of the drive motor and reducer for the apparatus shown in FIG. 4.

Referring again to FIGS. 4 and 5, the siding forming apparatus 200 includes a framework 202. The framework 202 supports bearing blocks 204, shown in FIGS. 10, 12, 14, 16 and 18. The bearing blocks 204 support the shafts for the forming rollers, as explained hereinafter. A motor 250 driving a reducer 252 by a belt 256, as also shown in FIG. 7, drives the rollers. A chain 254 engages a sprocket to drive all the roller sets. The various rollers are connected by chains 260 at one end of the shafts to ensure that the rollers are driven at the substantially same speed. The various chains 260 also provide for driving all of the various shafts off a single motor. To provide tension at the other ends of the shafts, a chain 262 links two sets of rollers.

Referring to FIG. 4, intermediate the roller sets forming the arcing surface, are roller sets 270, 272, 274, 276 and 278 along the hook edge of the rollers to maintain tension and to form the hook portion. A tension roller 268 is placed at the other edge of the panel 100 as it is being fed through the panel forming apparatus 200. Other rollers 266 provide guidance along the material path to ensure that the coil of blank material 120 does not drift to the left or the right as it proceeds through the various rollers. The tension of the chains 258 and 260 provide for driving from a single motor 250 and also ensure that relative timing and rotation of the various rollers is maintained so that the blank material 120 is fed at a continuous, even rate and the material does not veer to one side or the other. This avoids jamming of the forming device 200 and malformed panels 100.

Referring to FIG. 6, the panel forming apparatus 200 includes arc forming roller sets 206, 208, 210, 212, 214, 216 and 218. The arc forming roller sets 206, 208, 210, 212, 214, 216 and 218 generally have a concave upper roller A and a complementary convex lower roller B as explained hereinafter. Details of the lower rollers are omitted from FIG. 6 for improved clarity. In the early portion of the forming process, the upper rollers may be spaced apart so that the designation A1 and A2 is utilized while complementary lower rollers that are split apart are designated B1 and B2. In addition, the rollers may include a flange forming portions designated 207, 209, 211, 213 and 215. The rollers are generally mounted on shafts designated E with the number associated with each roller set. The shafts E extend out to the associated sprockets and are driven by the chains as explained above and shown in FIG. 5.

In addition to the arc forming rollers, tensioning roller sets 270, 272, 274, 276 and 278 are interposed along the hook edge intermediate and alternating with the arc forming rollers. Along an opposite edge, tension rollers 266 and 268 guide the material 120 and maintain proper tension so that the panels are formed correctly. The roller sets 270, 272, 274, 276 and 278 and the opposite roller 268 may be mounted about an angled axis of rotation and may have angled edges in order to maintain contact and facilitate proper tension. As explained hereinafter, as the blank panel material 120 is fed through the various forming roller sets, the edges of the material 120 are bent and manipulated so that a horizontal roller may not be adequate to maintain proper pressure and alignment of the material. As the material 120 is formed while passing through each successive roller set, the angle and shape of the support needed changes, as can be appreciated by those skilled in the art.

Prior to engaging the arc forming rollers, the material is first manipulated by passing through a punch station 220 having a punch roller 222. The rollers 222 include a plurality of punch members 224 projected radially outward and spaced about the periphery of the roller 222 along one edge. As the material is fed through the panel forming device 200, the punch roller 222 rotates and the punch members 224 form the mounting holes 106, through the material shown most clearly in FIGS. 1 and 2.

Figure 9:
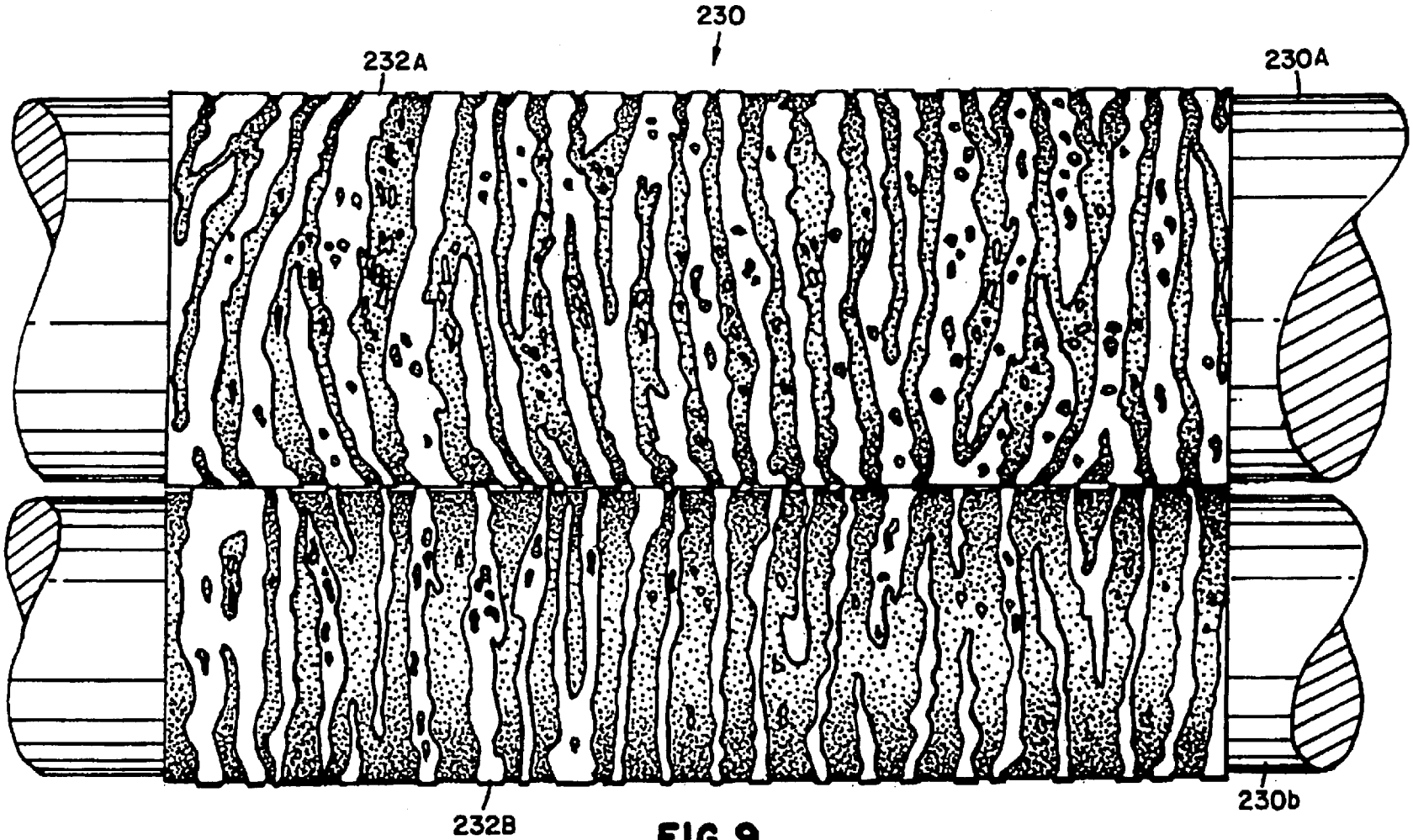
FIG. 9 shows a side elevational view of a pair of embossing rollers for the apparatus shown in FIG. 4.

Referring now to FIG. 9, the panel material 120 proceeds to a set of embossing rollers 230. The embossing roller set 230 includes an upper roller 230A and a lower roller 230B. The upper roller 230A includes an embossing surface 232A while the lower roller 230B has a complementary outer embossing surface 232B. As the material passes between the rollers 230A and 230B, the embossing surfaces 232A and 232B engage the panel and provide a texture simulating that of wood grain. It has been found that such embossing and additional texture provides added strength to the panels and resistance to holes, dents, etc. In addition, the embossed surface 120 of the panel aids in hiding such imperfections from the ordinary observer.

Figure 10:
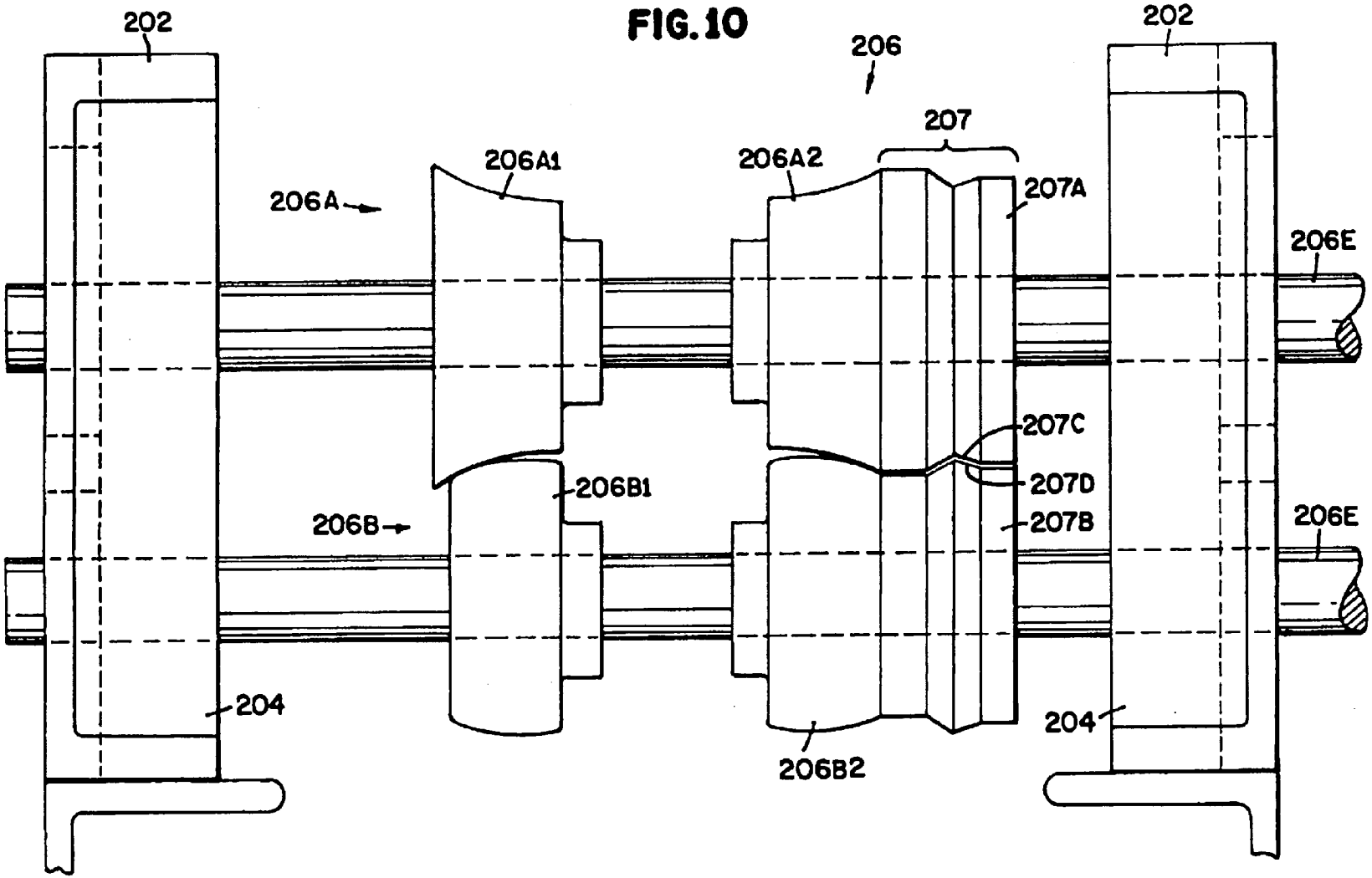
FIG. 10 shows a side elevational view of a first set of arcing rollers for the apparatus shown in FIG. 4.

Referring now to FIG. 10, after passing through the embossing roller set, the material engages the first arc forming rollers 206 on shafts 206E. The arc forming rollers 206 include upper rollers 206A1 and 206A2 having concave surfaces, and complementary lower rollers 206B1 and 206B2 having convex surfaces. The upper rollers 206A1 and 206A2 are spaced apart as are the lower rollers 206B1 and 206B2 to form the initial arc forming to the arcing surface of the panel. In addition, at the one edge of the material, a flange forming portion 207 abuts the rollers 206. The flange forming portion 207 includes an upper flange forming roller portion 207A and a lower roller portion 207B with complementary surfaces 207C and 207D imparting initial bends to the material 120 towards achieving the flange and hook as shown in FIGS. 1–3.

Figure 11:
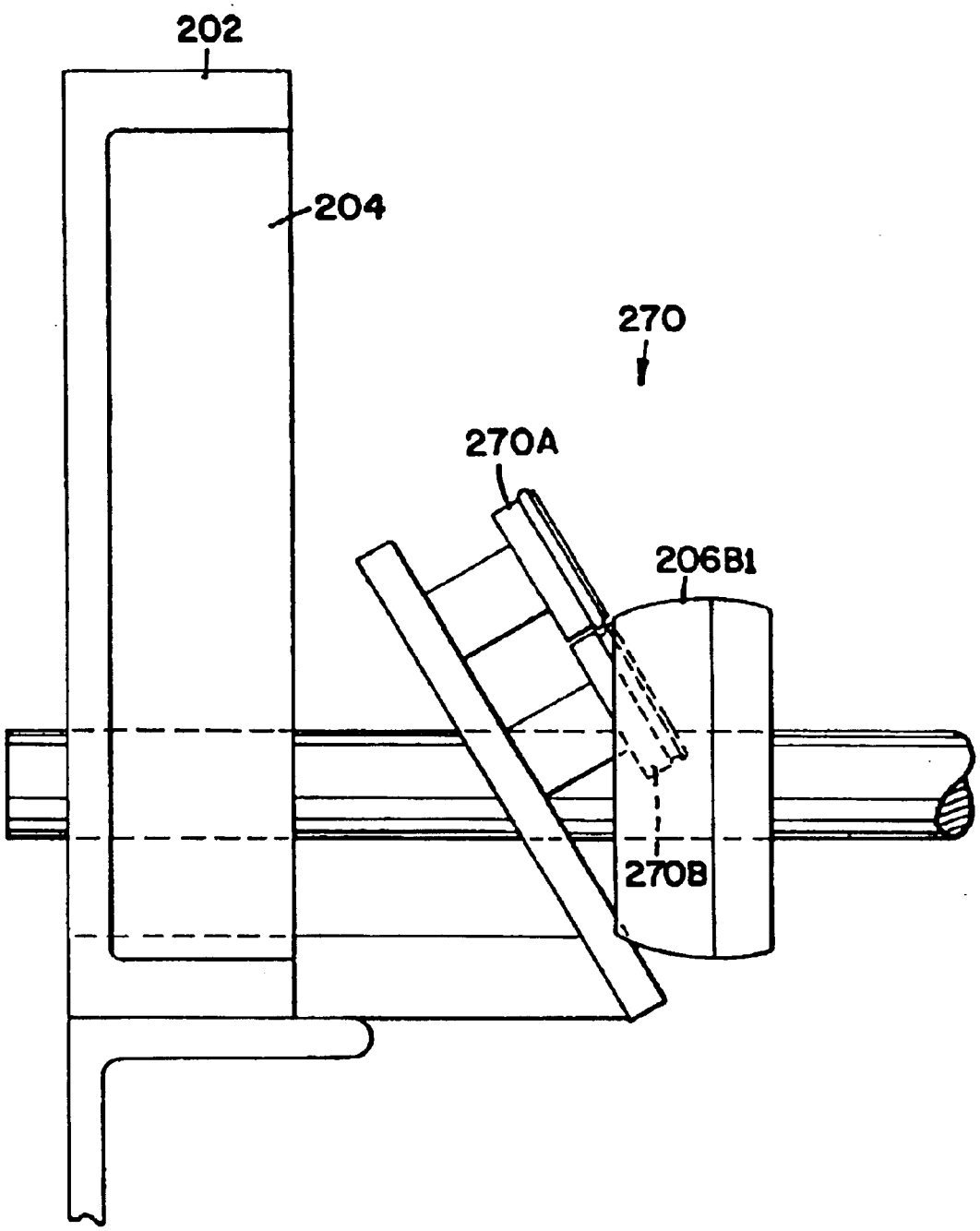
FIG. 11 shows a side elevational view of a first set of flange forming rollers for the apparatus shown in FIG. 4.
Figure 12:
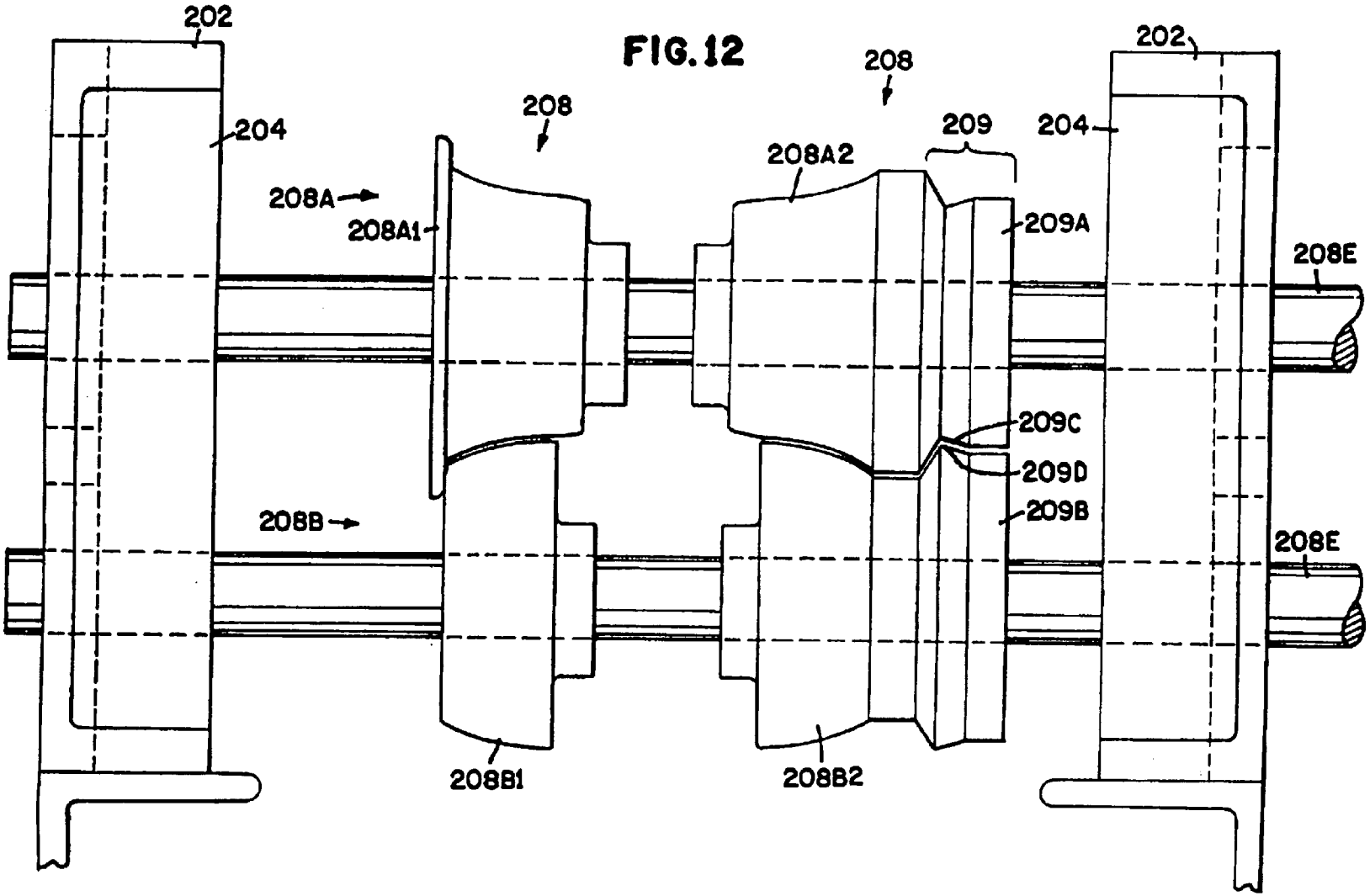
FIG. 12 shows a side elevational view of a second set of arcing rollers for the apparatus shown in FIG. 4.

Referring to FIG. 11, after passing through the roller set 230, the material is maintained in alignment by roller set 270 having an upper roller 270A and lower roller 270B engaging the edge of the material 120 corresponding to the bottom edge of the panel 100. The rollers 270 form an initial bend in the material towards achieving the hook portion 110.

Following passing through roller set 270, the blank material engages roller set 208 on shafts 208E. Roller set 208 includes upper rollers 208A1 and 208A2 and lower complementary rollers 208B1 and 208B2. The upper rollers 208A1 and 208A2 include a concave arcing surface while the corresponding lower rollers 208B1 and 208B2 have a convex surface with a complementary arc. The roller set 208 is slightly more arced than the roller set 206 shown in FIG. 10 so that additional arcing is performed on the material 120. In addition, roller 208A1 includes an outer flange that continues to bend the lower edge and direct it downward for forming the lower hook portion. At the opposite end of the rollers is an additional flange forming portion 209 including an upper portion 209A on roller 208A2 and a lower flange forming portion 209B on lower roller 208B2. Surface 209C includes a slightly more exaggerated channel with a complementary peak 209D extending into the channel 209C. This structure bends the flange to a greater degree than continues from the surfaces shown as shown in FIG. 10.

Figure 13:
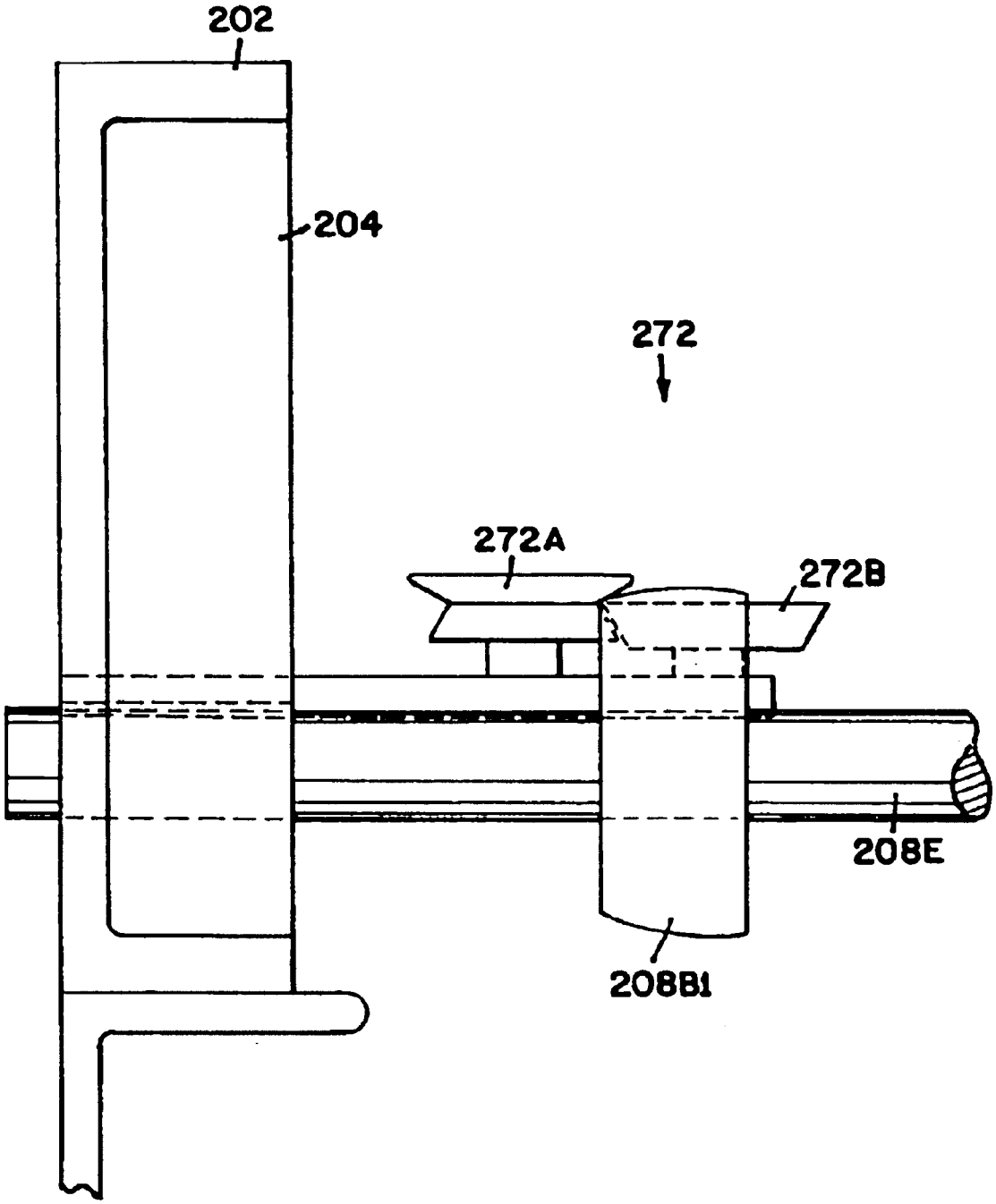
FIG. 13 shows a side elevational view of a second set of flange forming rollers for the apparatus shown in FIG. 4.

Referring to FIG. 13, following passage through roller set 208, the edge of the material corresponding to the lower edge of the panel engages roller set 272 including a complementary first roller 272A and a complementary second roller 272B. The edges of the rollers 272A and 272B engage an angled edge of the material extending back inward to place a greater bend to the hook portion.

Figure 14:
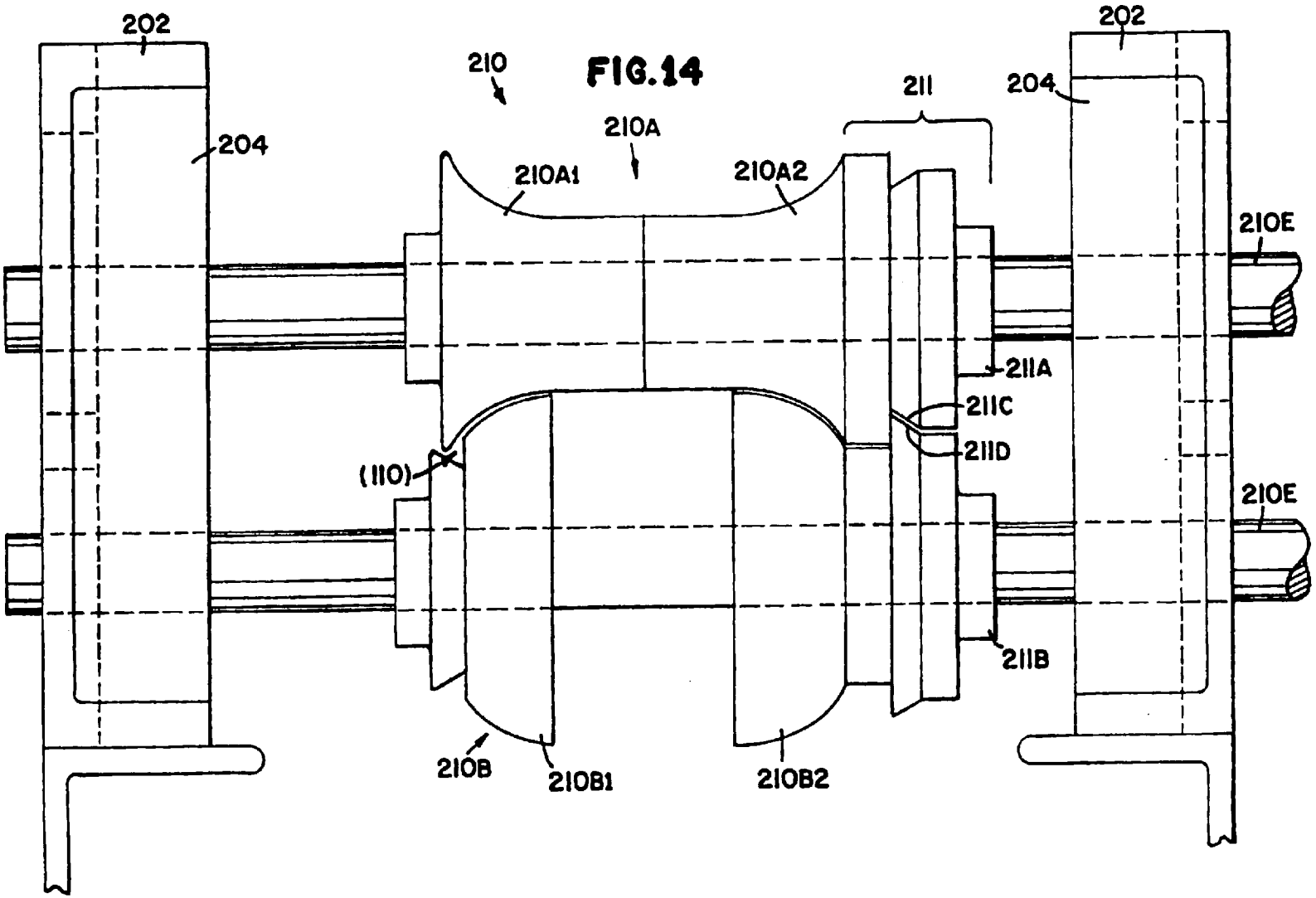
FIG. 14 shows a side elevational view of a third set of arcing rollers for the apparatus shown in FIG. 4.

Referring to FIG. 14, roller set 210 is engaged following passage through roller set 272. Roller set 210 includes an upper roller set 210A having rollers 210A1 on upper shaft 210E and 210A2 and lower roller set 210B including lower rollers 210B1 and 210B2 on lower shaft 210E. Rollers 210A1 and 210A2 have concave arcing portions while rollers 210B1 and 210B2 have complementary convex portions. In addition, the edge of rollers 210A1 and 210B1 are arranged so that the partially formed hook portion 110 of the panel is fed beyond the end of convex portion of roller 210B1 and maintain the material in alignment. At the opposite ends of the rollers on 210A2 and 210B2 is a flange forming portion 211. Flange forming portion 211 includes an upper forming portion 211A on roller 210A2 and a lower portion 211B on lower roller 210B2. The portion 211A includes a forming surface 211C including a channel with a nearly horizontal side and portion 211B includes a complementary peak extending into the channel to continue forming the flange portion of the material.

Figure 15:
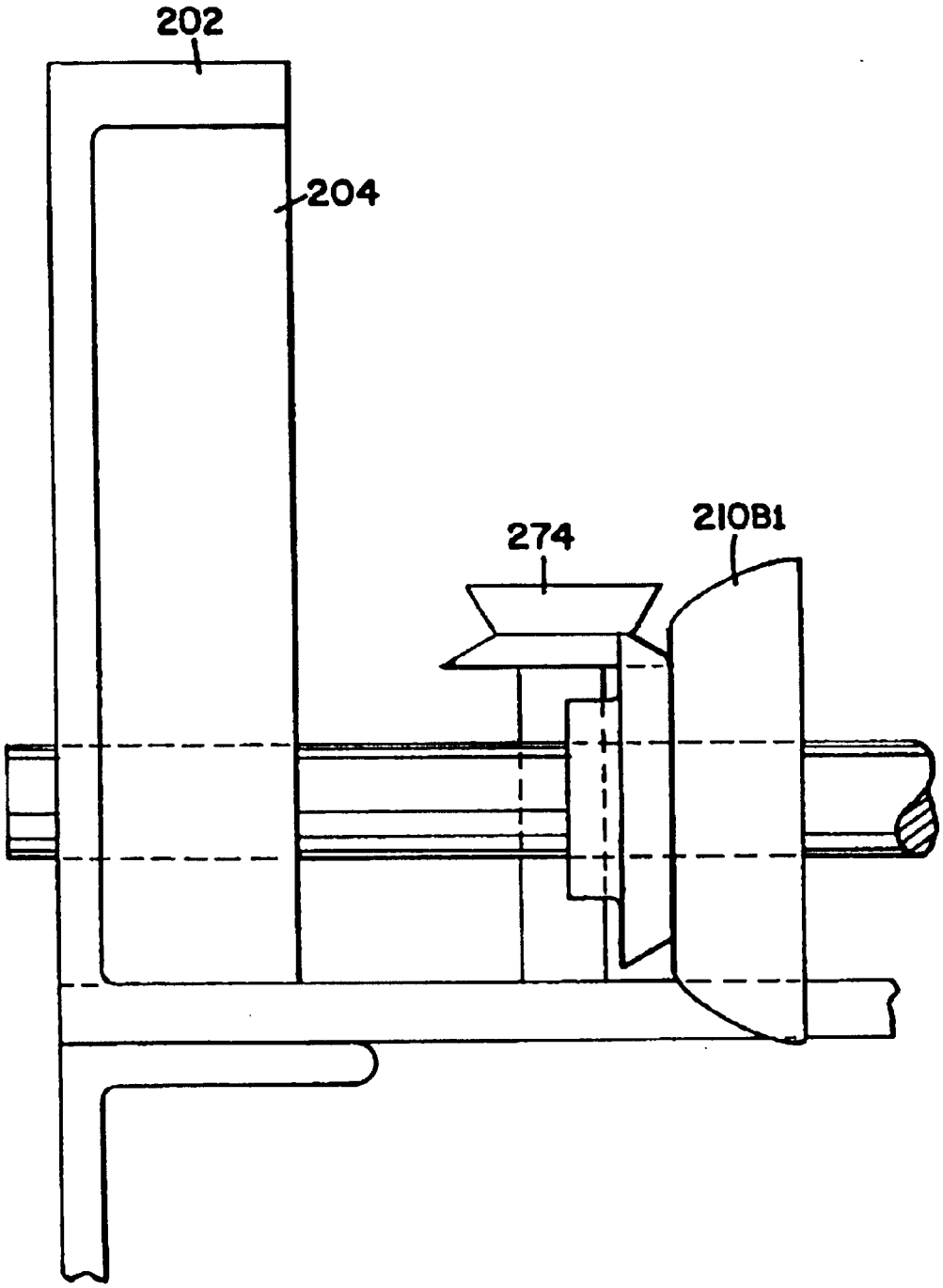
FIG. 15 shows a side elevational view of a third set of flange forming rollers for the apparatus shown in FIG. 4.

Referring to FIG. 15, following passage through roller set 210, the material engages roller set 274 including roller set 274A and 274B. Roller set 274 includes an angled edge maintaining and bending the lower edge of the material further forming the hook portion.

Figure 16:
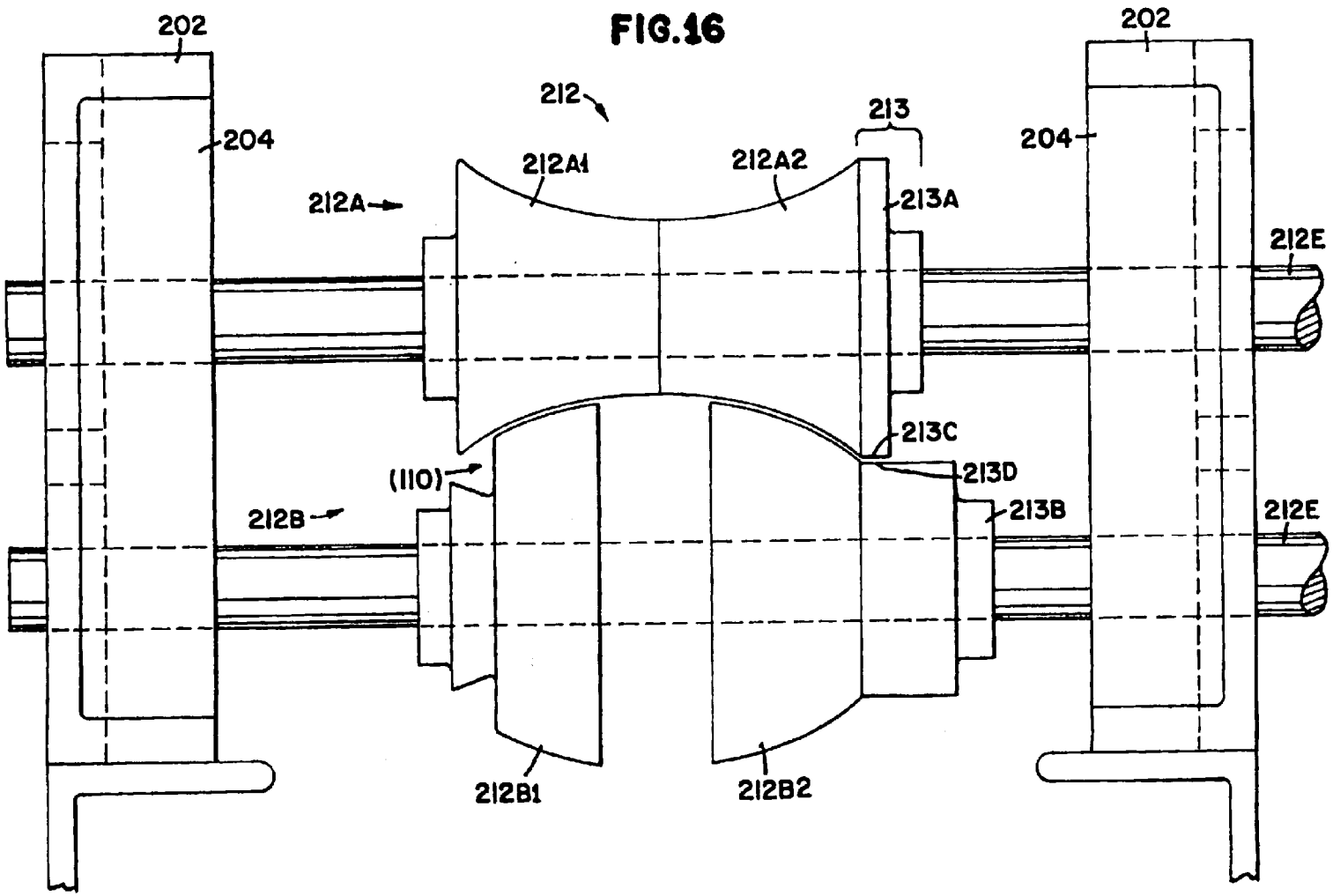
FIG. 16 shows a side elevational view of a fourth set of arcing rollers for the apparatus shown in FIG. 4.
Figure 17:
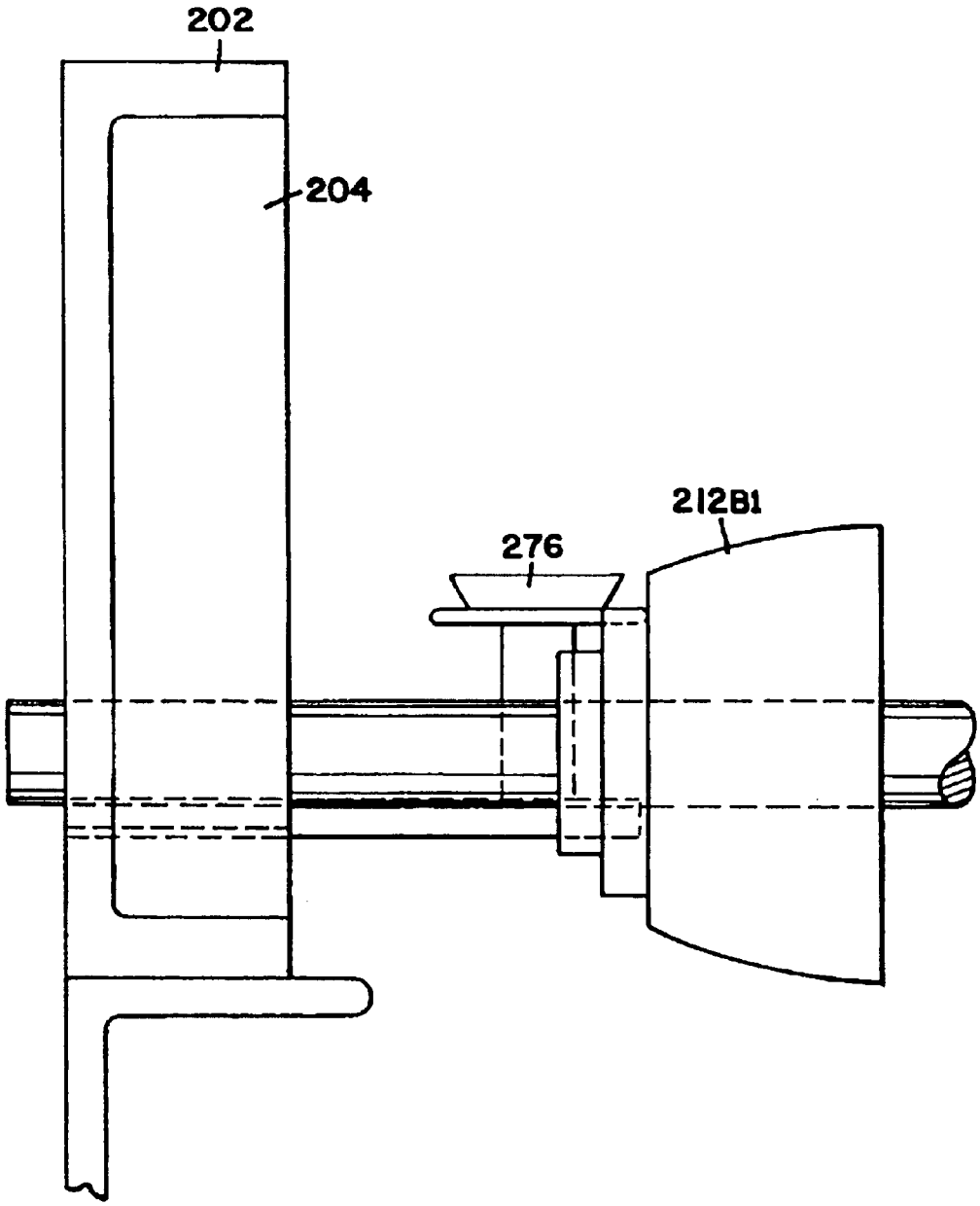
FIG. 17 shows a side elevational view of a fourth set of flange forming rollers for the apparatus shown in FIG. 4.

Referring to FIG. 16, the material next engages a roller set 212 including upper rollers 212A and lower rollers 212B on shaft 212E. Upper rollers 212A include a first roller 212A1 and 212A2 while lower rollers 212 include complementary rollers 212B1 and 212B2. The upper rollers 212A have a concave forming surface while the lower rollers 212B include a complementary convex forming surface. In addition, roller 212B1 includes an outer edge providing a space for the hook portion 110 of the panel. At the opposite end of the rollers, is an additional flange forming station 213 including first portion 213A and second portion 213B. Forming surfaces 213C and 213D provide realignment of the hook portion in the flange of the material.

Following passage through roller set 212, the material engages roller 276. Roller 276 includes an angled edge having an upper and lower portion providing a triangular profile and added bend to the hook portion of the material.

Figure 18:
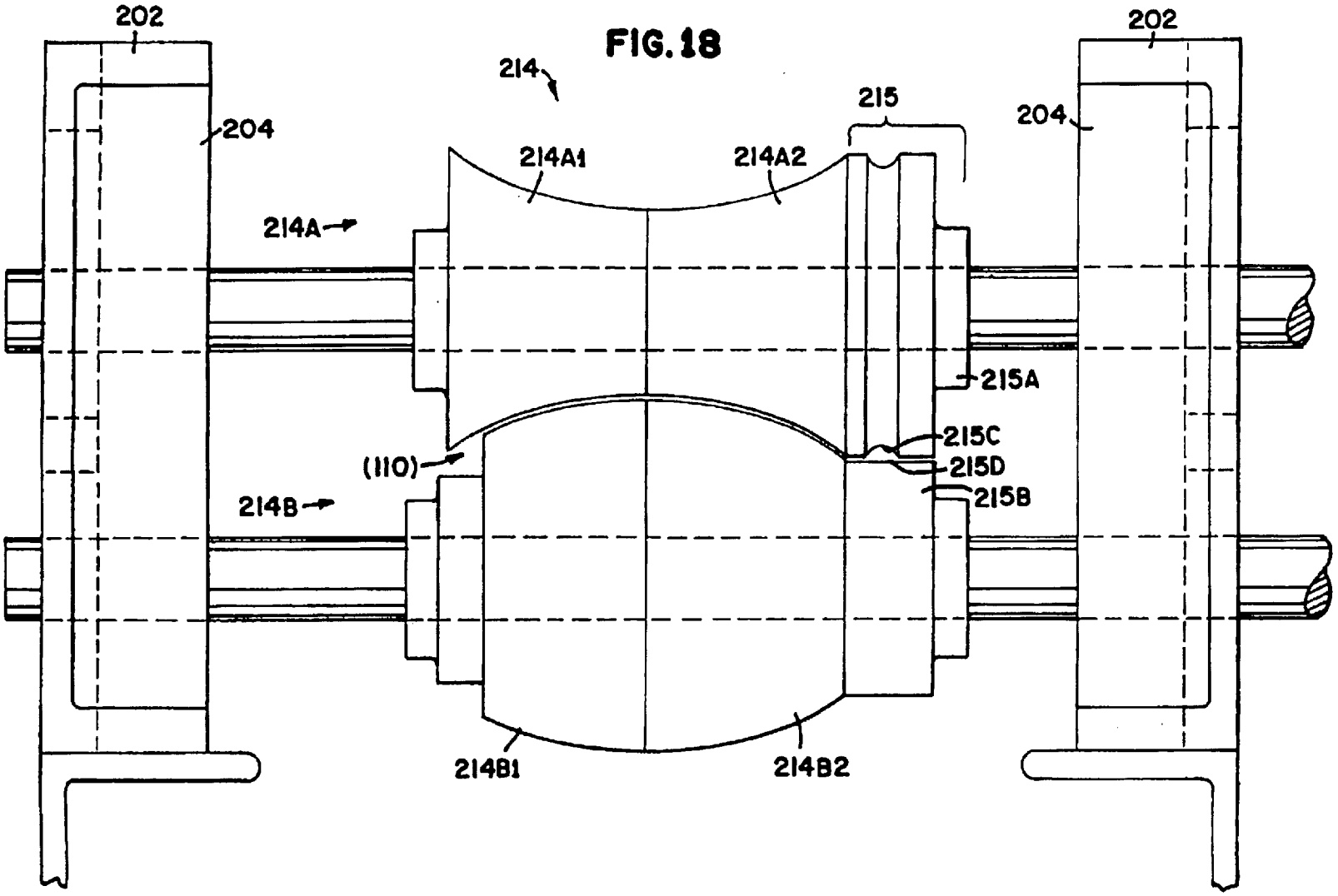
FIG. 18 shows a side elevational view of a fifth set of arcing rollers for the apparatus shown in FIG. 4.

Referring now to FIG. 18, the material next engages roller set 214. Roller set 214 includes upper concave rollers 214A and lower complementary convex rollers 214B on shafts 214E. Upper roller set 214A includes a first roller 214A1 and second roller 214A2 while lower roller set includes a first roller 214B1 and lower roller 214B2. The upper rollers 214A1 and 214A2 abut one another as do the lower rollers 214B1 and 214B2. The roller set 214 has a slightly greater arc than the preceding rollers 212. At a lower edge of the material, the roller 214A1 extends beyond the convex surface of roller 214B1 to provide space for the hook portion 110 of the material. At the opposite edge, the flange forming portion 215 includes an upper portion 215A on roller 214A2 while the lower portion 215B extends from roller 214B2. A forming surface 215C includes a gap providing for the hook portion of the flange while the lower surface 215D is substantially planar.

Figure 19:
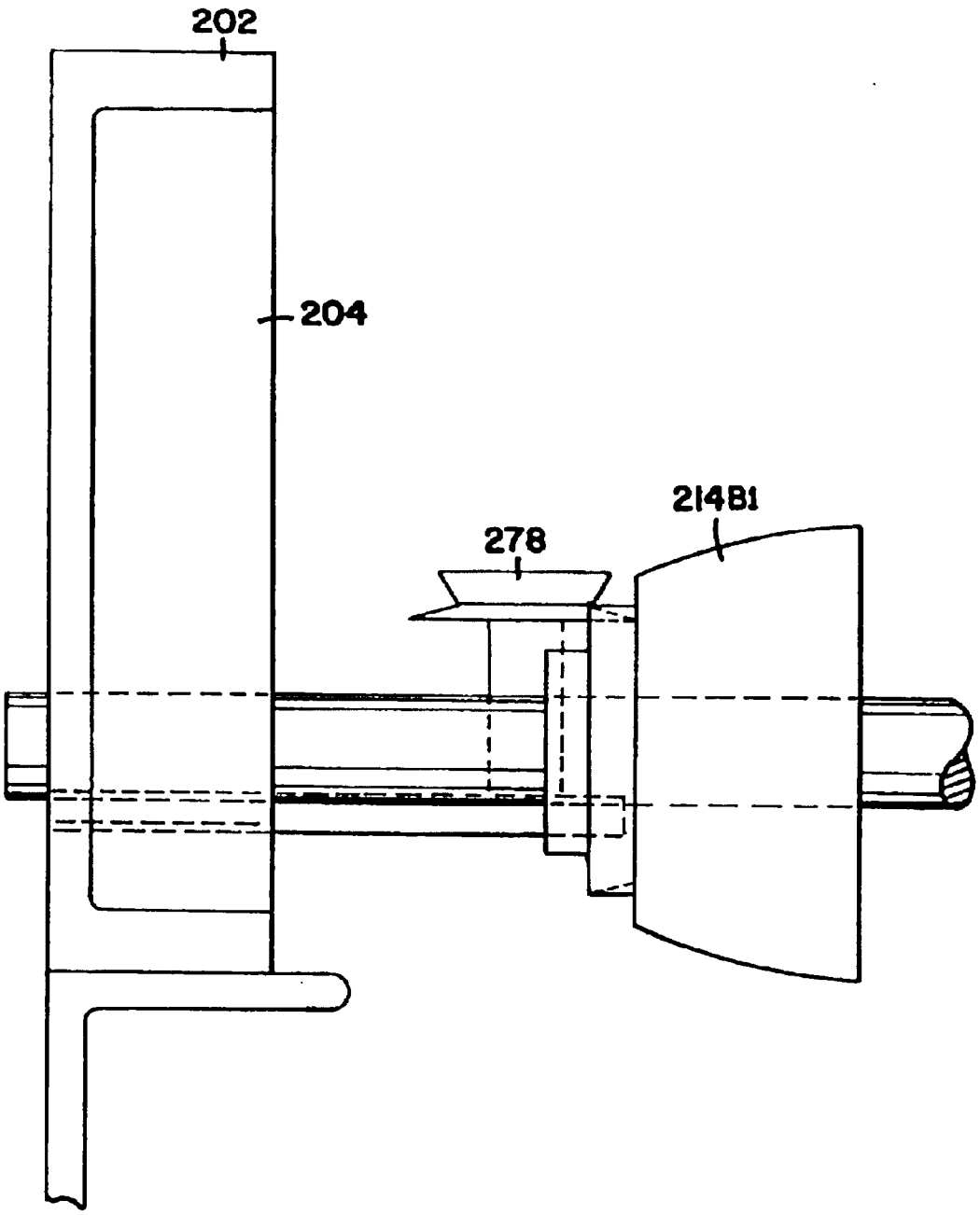
FIG. 19 shows a side elevational view of a sixth set of flange forming rollers for the apparatus shown in FIG. 4.
Figure 20:
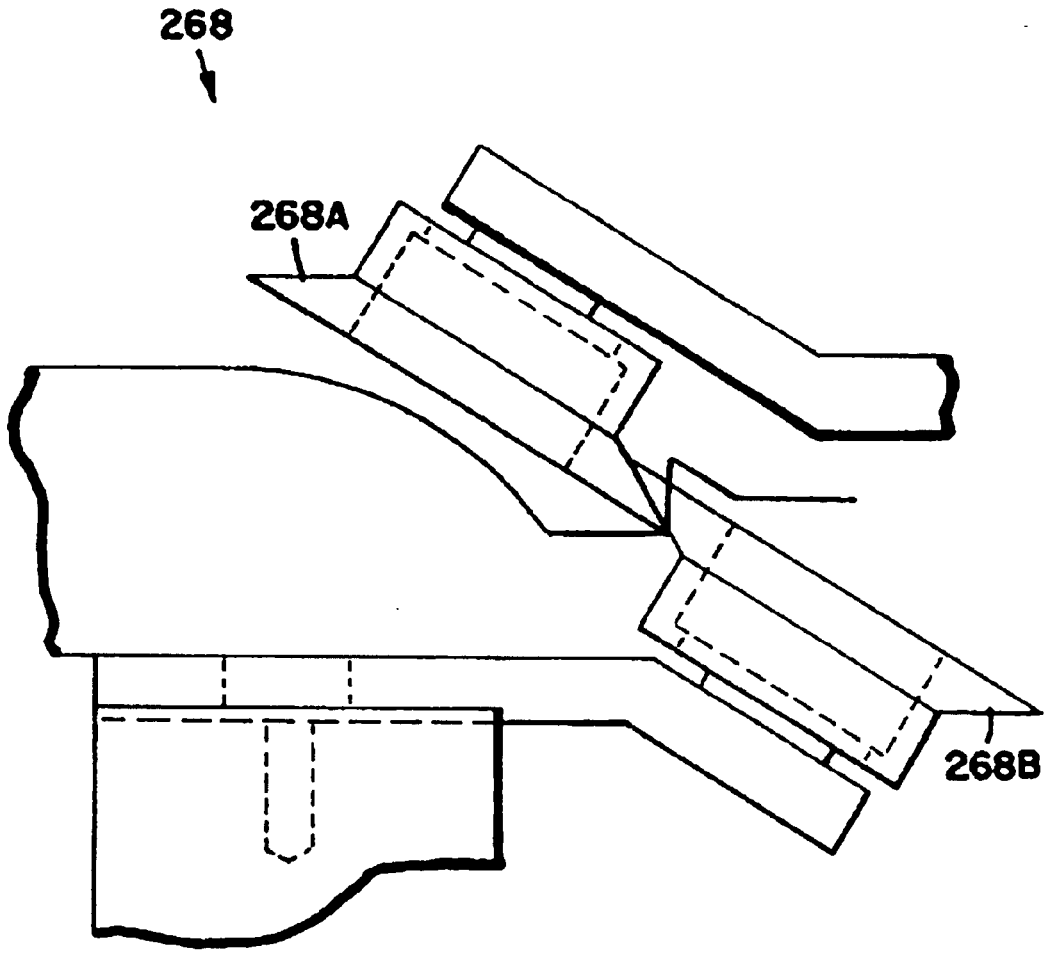
FIG. 20 shows a side elevational view of a set of lower edge forming rollers for the apparatus shown in FIG. 4.

Referring to FIG. 19, the material then passes against roller 278. Roller 278 includes an engaging surface having an angled upper portion and a horizontal lower portion that engages the lower edge of the material.

After passing roller 278, the material engages a roller set 216, as shown in FIG. 6. Roller set 216 has a configuration substantially the same as roller set 214 as forming at this stage is to maintain the shape and ensure that the proper arc is formed. However, the opposite edge engages roller set 268 including upper roller 268A and lower roller 268B engaging and providing final positioning of the flange portion while maintaining the proper form and alignment and fine. Following passage through roller set 216, the final roller set 218 also has the same configuration and arcing surface as roller sets 214 and 216. Tension rollers 266 maintain the material in alignment and ensure the flange is properly oriented.

Figure 8:
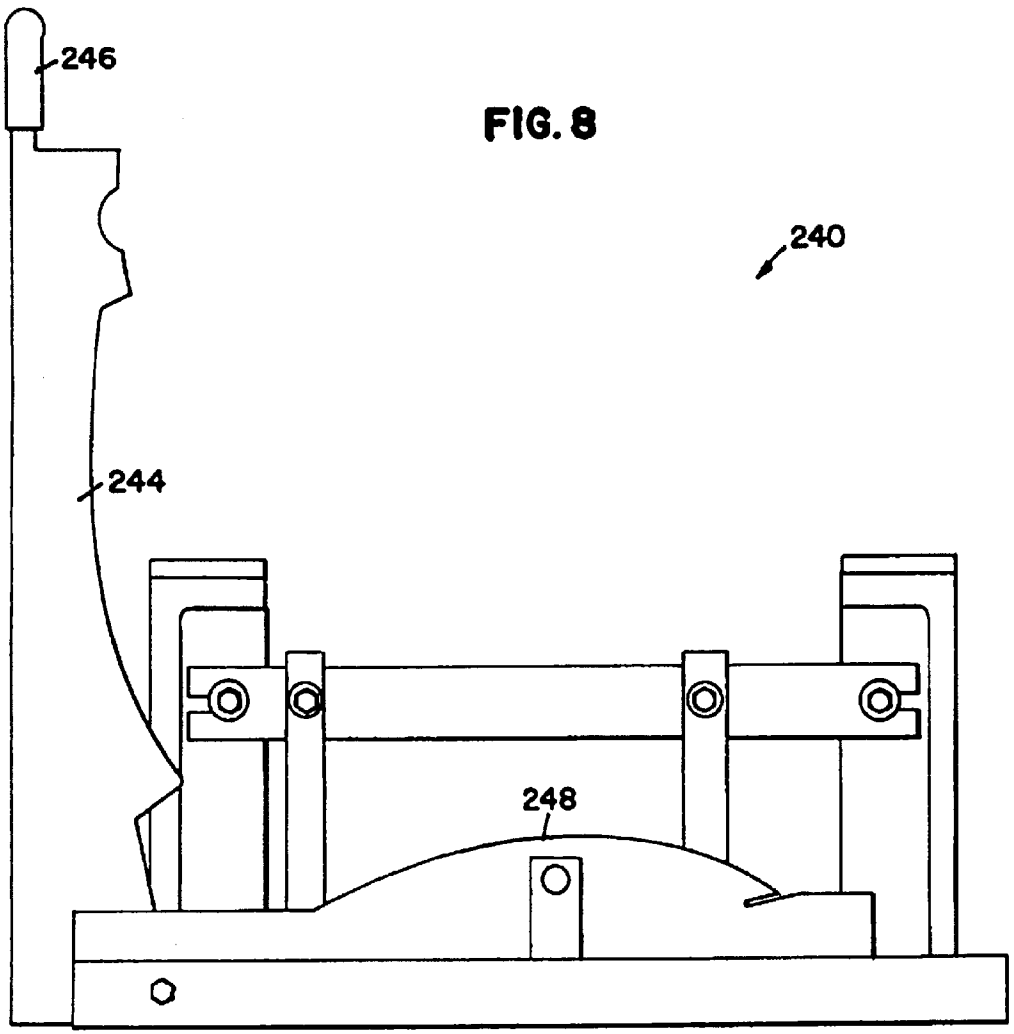
FIG. 8 shows an end view of a cutting station for the apparatus shown in FIG. 4.

When the panel has been formed into the blank with the desired profile as shown in FIGS. 1–3, the panels are then cut to the predetermined length at the cutting station 240 shown in FIG. 8. The cutting station 240 is mounted on the sliding frame, as shown in FIG. 4. As shown in FIG. 8, the cutting station 240 includes die 248 substantially conforming to the arc of the panel. The cutting station includes a pivoting blade 244 having an arcing surface that slices through the panel at the predetermined length. A handle 246 extends outward from the end of the blade 244 to provide mechanical advantage during the cutting motion for easily slicing through the panel material. The complementary arcing surfaces that substantially conform to the arc of the panels ensures that a clean cut is made. As the cutting station 240 is slidably mounted, the desired length is obtained so that a proper fit may be made to meet the needs for each siding panel.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for making metal siding panels, comprising:

a feeder;

a plurality of roller sets, wherein first ones of the rollers have a concave portion and complementary second ones of the rollers have a convex portion, and wherein the concave portion of a first roller set has a larger radius profile than a last roller set;

bending means adapted for forming a first flange proximate a first end of the rollers;

continuous punch means;

continuous embossing means adapted for continuously forming an embossed pattern.

2. An apparatus according to claim 1, further comprising a plurality of intermediate roller sets, wherein each successive roller set has a profile with a radius equal to or smaller than the preceding roller profile.

3. An apparatus according to claim 1, wherein the bending means is adapted for forming a second flange complementary to the first flange.

4. An apparatus according to claim 1, therein the embossing means comprises opposed embossing rollers having a patterned surface.

5. An apparatus according to claim 1, wherein the rollers are aligned linearly, along a direction perpendicular to the axis of each roller.

6. An apparatus according to claim 1, wherein the each successive roller set has an axial profile radius no larger than a radius of a preceding roller set.

7. An apparatus according to claim 1, further comprising means for supporting a continuous coil of blank material.

8. An apparatus according to claim 1, further comprising a support for supporting a continuous coil of blank material.

9. An apparatus for making metal siding panels, comprising:

a feeder;

a plurality of roller sets, wherein first ones of the rollers have a concave portion and complementary second ones of the rollers have a convex portion, and wherein the concave portion of a first roller set has a larger radius profile than a last roller set;

a bending device for forming a first flange proximate a first end of the rollers;

a continuous punch for forming mounting holes in the panels; and an embosser comprising opposed rollers for continuously forming an embossed pattern on the panels.

10. An apparatus according to claim 9, further comprising a plurality of intermediate roller sets, wherein each successive roller set has a profile with a radius equal to or smaller than the preceding roller profile.

11. An apparatus according to claim 9, wherein the bending device forms a second flange complementary to the first flange.

12. An apparatus according to claim 9, wherein the rollers are aligned linearly, along a direction perpendicular to the axis of each roller.

13. An apparatus according to claim 9, wherein the each successive roller set has an axial profile radius no larger than a radius of a preceding roller set.

14. An apparatus according to claim 13, wherein the final roller set and at least one preceding roller set have the same axial profile radius.

15. An apparatus according to claim 9, wherein the embosser, the punch and the first roller sets are chain driven.

16. An apparatus according to claim 9, wherein the patterned surface comprises a wood grain surface.

17. An apparatus according to claim 9, wherein the continuous punch comprises a punch roller with a plurality of punch members projecting radially outward.

18. An apparatus for making metal siding panels, comprising:

a feeder;

a plurality of forming roller sets, wherein first ones of the rollers having a concave portion and complementary second ones of the rollers have a convex portion, and wherein the concave portion of a first forming roller set has a larger radius profile than a last forming roller set, wherein the final forming roller set and at least one preceding forming roller set have the same axial profile radius;

a bending device for forming a first flange proximate a first end of the rollers;

a continuous punch roller with a plurality of punch members projecting radially outward for forming mounting holes in the panels; and an embosser comprising opposed embossing rollers having a wood grain surface for continuously forming an embossed wood grain pattern on the panels.

19. An apparatus according to claim 18, wherein the embossing rollers, the punch roller and the first forming roller sets are chain driven.

* * * * *